US006805571B2

(12) United States Patent
Huang

(10) Patent No.: US 6,805,571 B2
(45) Date of Patent: Oct. 19, 2004

(54) ELECTRICAL CONNECTOR ASSEMBLY HAVING LOCKING DEVICE

(75) Inventor: Chien-Hsun Huang, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/394,976

(22) Filed: Mar. 20, 2003

(65) Prior Publication Data

US 2004/0166714 A1 Aug. 26, 2004

(30) Foreign Application Priority Data

Feb. 26, 2003 (TW) ..... 92202950

(51) Int. Cl.[7] ..... H01R 13/62
(52) U.S. Cl. ..... 439/330; 439/357
(58) Field of Search ..... 439/330, 357, 439/733.1, 74, 350, 358, 353, 354

(56) References Cited

U.S. PATENT DOCUMENTS 4,637,670 A * 1/1987 Coller et al. ..... 439/330 X
4,954,088 A * 9/1990 Fujizaki et al. ..... 439/330 X
5,395,265 A 3/1995 DiMondi et al.
5,836,773 A 11/1998 McHugh et al.
5,876,217 A 3/1999 Ito et al.
6,383,018 B2 * 5/2002 Torii ..... 439/357 X
6,475,010 B1 11/2002 Yu

* cited by examiner

*Primary Examiner*—Son V. Nguyen
(74) *Attorney, Agent, or Firm*—Wei Te Chung

(57) ABSTRACT

An electrical connector assembly (1) includes a first connector (2) and a second connector (3) engageable with the first connector. The first connector has a first dielectric housing (20) defining a pair of receiving spaces (202), a number of first terminals received in the first housing and a pair of latches (24) retained in the receiving spaces. Each latch includes a retaining portion and a curved spring portion (242) connecting with the retaining portion. The second connector has a second dielectric housing defining a pair of recesses (34) on opposites outer sides thereof and a number of second terminals (32) received in the second dielectric housing. The spring portions of the latch securely engage with the corresponding recess of the second dielectric housing, whereby the first connector stably mates with the second connector.

5 Claims, 6 Drawing Sheets

ELECTRICAL CONNECTOR ASSEMBLY HAVING LOCKING DEVICE

BACKGROUND OF THE INVENTION

1. Field of the Invention

The present invention relates to an electrical connector assembly, and particularly to an electrical connector assembly having a locking device for securing two mated connectors thereof together.

2. Description of Related Art

It is well known that a board-to-board connector assembly is widely used for connecting two printed circuit boards (PCBs) together and includes a plug connector mounted on a first PCB and a receptacle connector mounted on a second PCB to electrically connect with the plug connector. The connector assembly is often equipped with a locking device for ensuring a reliable connection between the receptacle connector and the plug connector, thereby ensuring a reliable signal transmission between the PCBs.

U.S. Pat. No. 5,876,217 discloses a connector assembly including a plug connector and a receptacle connector. The plug connector includes an insulative housing defining a plurality of recesses and the receptacle connector includes a plurality of terminals each having a locking portion. In assembly, the locking portion of each terminal of the receptacle connector engages with the corresponding recess of the housing of the plug connector, whereby the plug connector and the receptacle connector securely engage with each other. However, the terminal having the locking portion is difficult to manufacture. Furthermore, because each terminal of the receptacle is subject to a retaining force between the locking portion thereof and the corresponding recess of the housing of the plug connector, repeated engagement between the plug and the receptacle connectors may result in the terminals being deformed so that the performance of the signal transmission is adversely affected.

U.S. Pat. No. 5,836,773 discloses a board-to-board connector assembly with a locking device. The locking device includes a protrusion formed on a sidewall of an insulative housing of a plug connector and a cutout defined in a sidewall of an insulative housing of a receptacle connector. By the engagement of the protrusion and the cutout, the plug connector stably mates with the receptacle connector to ensure a reliable signal transmission therebetween. Because the protrusion and the sidewall around the cutout is made of plastic material, the protrusion and the cutout engage with each other via their inherent characteristic, a long-term engagement therebetween will cause plastic deformation and this deformation can never resume. As a result, the protrusion cannot reliably engage with the cutout.

U.S. Pat. No. 5,395,265 discloses a board-to-board connector assembly including a plug connector, a receptacle connector and an additional locking device. The locking device includes two pairs of metal latches respectively assembled on opposite sides of the plug connector and the receptacle connector. The metal latch on the plug connector locks with the corresponding metal latch on the receptacle connector so that the plug connector securely connects with the receptacle connector. However, the locking device requires two pairs of metal latches, thereby wasting the materials and increasing the cost of manufacture.

Hence, an electrical connector assembly with an improved locking device is desired to overcome the disadvantages and problems of the prior art.

SUMMARY OF THE INVENTION

An object of the present invention is to provide an electrical connector assembly having an improved locking device for ensuring a reliable engagement between a plug and a receptacle connectors thereof.

To achieve the above object, an electrical connector assembly in accordance with the present comprises a first connector and a second connector. The first connector comprises a first dielectric housing defining a receiving space at one end thereof, a plurality of first terminals received in the first dielectric housing and a metallic latch assembled on the first dielectric housing. The second connector comprises a second dielectric housing defining a recess at one end thereof and a plurality of second terminals received in the second dielectric housing and electrically connecting the first terminals. The latch comprises a retaining portion retained in the receiving space of the first housing and a spring portion connecting with the retaining portion to engage with the recess of the second housing.

Other objects, advantages and novel features of the invention will become more apparent from the following detailed description when taken in conjunction with the accompanying drawings.

DETAILED DESCRIPTION OF THE INVENTION

Figure 1:
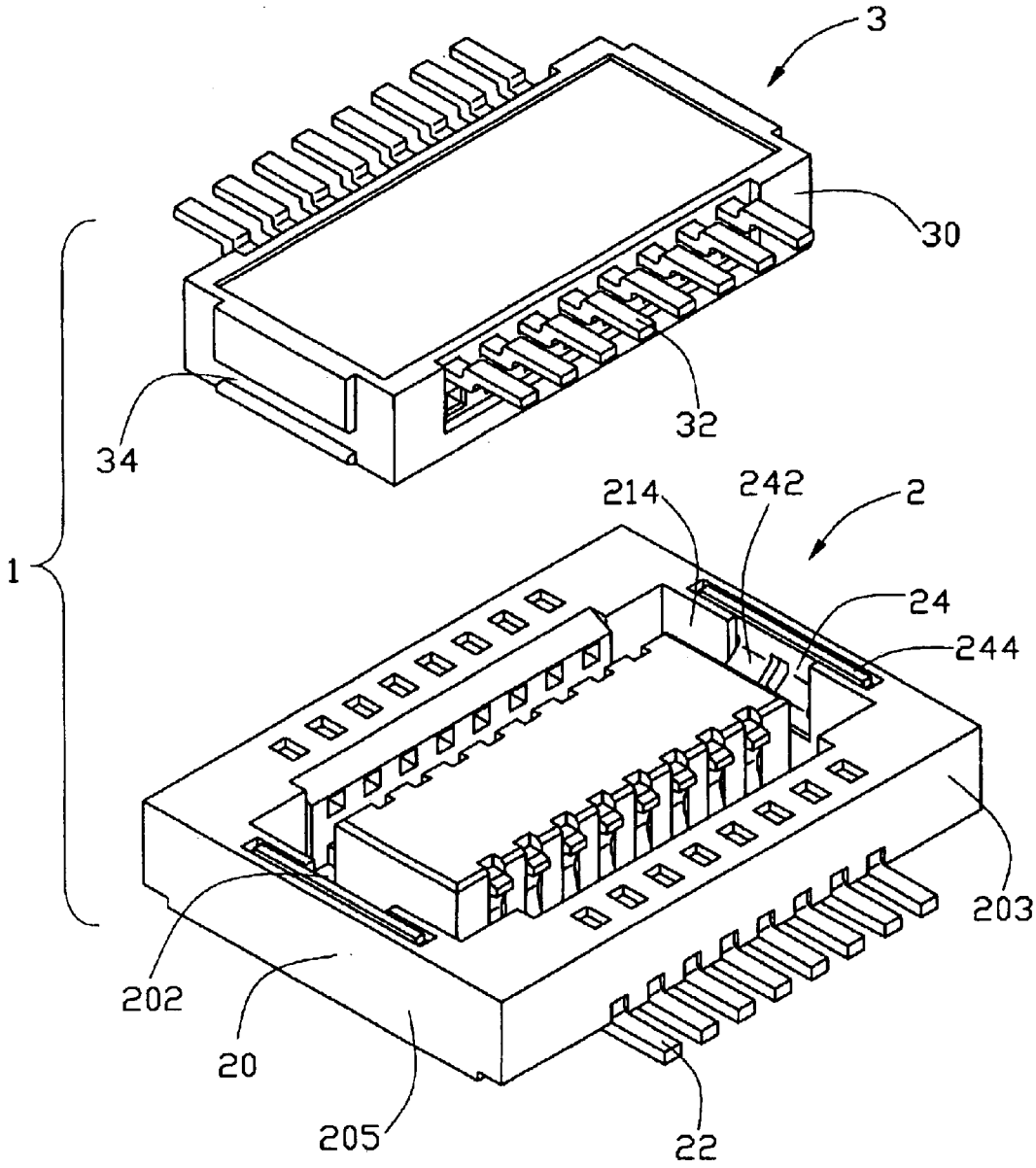
FIG. 1 is an exploded perspective view of an electrical connector assembly in accordance with the present invention.

Referring to FIG. 1, an electrical connector assembly 1 in accordance with the present invention comprises a first connector 2 and a second connector 3 respectively mounted on a first and a second printed circuit boards (not shown). The first connector 2 includes a first dielectric housing 20, a plurality of first terminals 22 received in the first dielectric housing 20 and a pair of metallic latches 24 retained in the first dielectric housing 20. The second connector 3 includes a second dielectric housing 30 defining a pair of recesses 34 on opposite sides thereof and a plurality of second terminals 32 received in the second dielectric housing 30 for electrically connecting with the corresponding first terminals 22. The first terminals 22 and the second terminals 32 are respectively soldered to the first and the second printed circuit boards, whereby the first connector 2 and the second connector 3 are securely mounted on the first and the second printed circuit boards.

Figure 2:
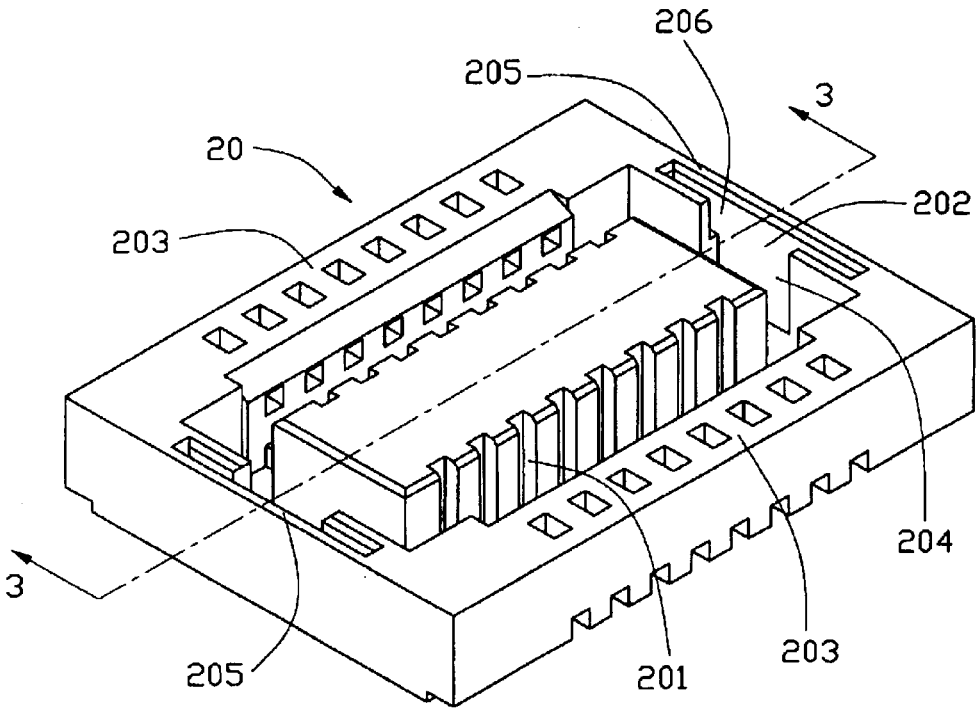
FIG. 2 is a perspective view of a first dielectric housing of a first connector shown in FIG. 1.
Figure 3:
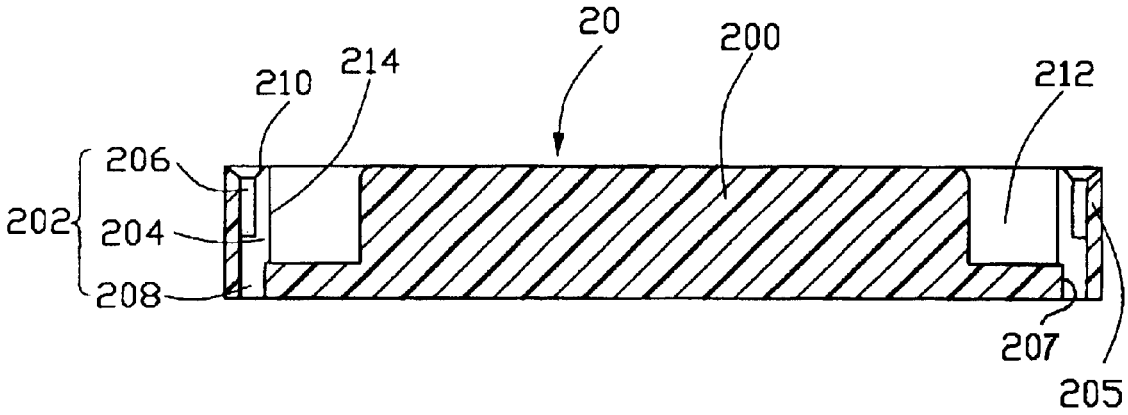
FIG. 3 is a cross-sectional view taken along line 3—3 of FIG. 2.

Referring to FIGS. 2–3, the first dielectric housing 20 comprises a central portion 200, a pair of end walls 205 and a pair of side walls 203 connecting to the end walls 205. The central potion 200, the end walls 205 and the sidewalls 203 together define an engaging space 212 therebetween for receiving the corresponding portion of the second connector 3. The first dielectric housing 20 defines a plurality of channels 201 communicating with the engaging space 212 and receiving the corresponding first terminals 22. Each end wall 205 defines a receiving space 202 communicating with the engaging space 212 for receiving the latch 24 therein. A reference edge 207 (FIG. 3) is defined in a bottom wall of the housing and faces each corresponding receiving space 202. Each receiving space 202 includes a cutout 204 formed in a middle portion of an inner side face 214 of the first dielectric housing 20, an indentation 206 above the cutout 204 and a slot 208 below the cutout 204. The indentation 206 and the slot 208 both communicate with the cutout 204. The receiving space 202 defines a first lead-in 210 on a top end thereof for facilitating and guiding the insertion of the latch 24 into the receiving space 202.

Figure 4:
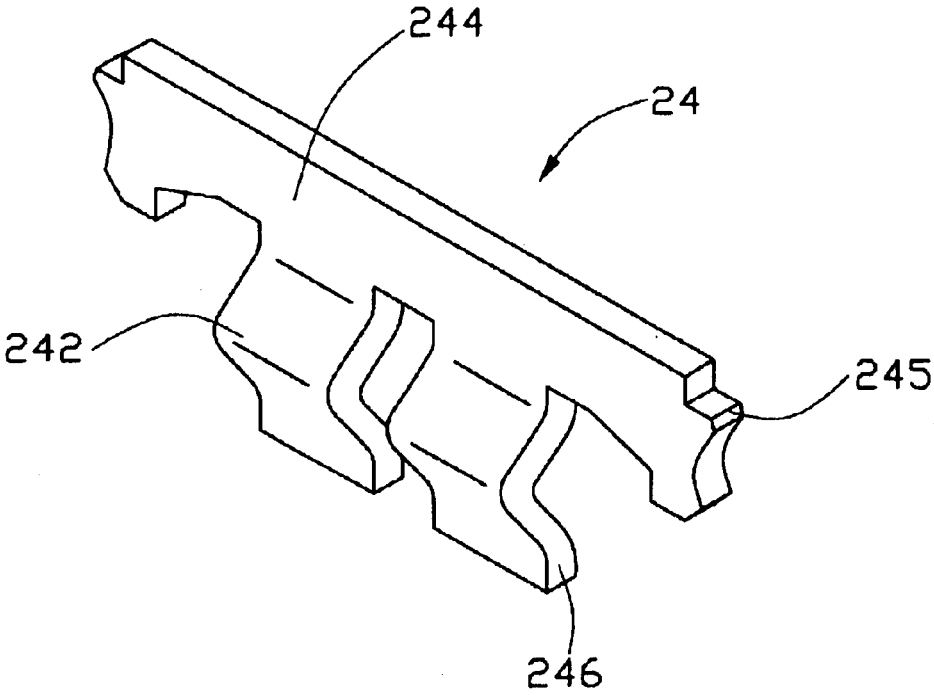
FIG. 4 is an enlarged perspective view of a latch of the first connector shown in FIG. 1.
Figure 5:
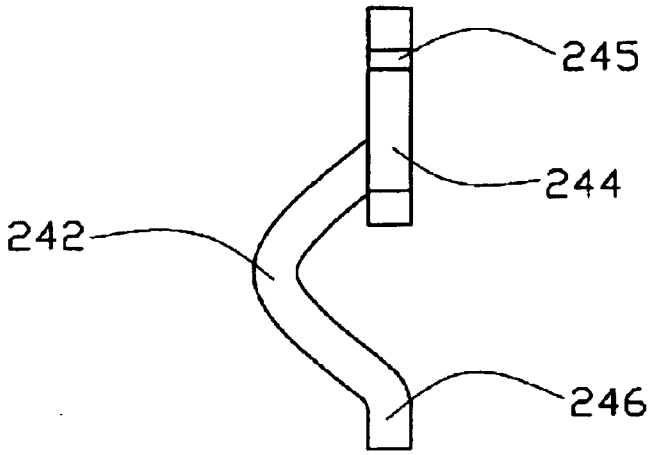
FIG. 5 is a side view of the latch of FIG. 4.

Referring to FIGS. 4–5, each latch 24 comprises an elongated retaining portion 244, spring portion 242 downwardly extending from a lower end of the retaining portion 244 and a locking portion 246 extending downwardly from the spring portion 242. The retaining portion 244 and the locking portion 246 are coplanar and the retaining portion 244 defines a plurality of barbs 245 on opposite longitudinal ends thereof. The spring portion comprises a pair of spring legs and each has of a curved shape. The latch 24 is guided into the receiving space 202 of the first dielectric housing 20 via the first lead-in 210 of the receiving space 202. The retaining portion 244 is received in the indentation 206 with the barbs 245 interferential engagement with inner sides of the indentation 206. The locking portion 246 is moveablely received in the slot 208 of the receiving space 202 and the spring portion 242 protrudes into the engaging space 212 of the first dielectric housing 20 to engage with the recess 34 of the second connector 3.

Figure 6:
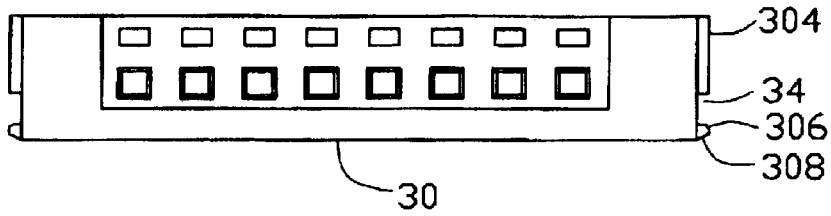
FIG. 6 is a side view of a second dielectric housing of a second connector shown in FIG. 1.

Referring to FIG. 6, the second dielectric housing 30 is formed with a pair of protrusions 304 on opposite outer side faces and adjacent to a bottom face thereof and a pair of projecting ribs 306 on the opposite outer side faces and adjacent to a top face thereof. The protrusions 304 and the corresponding projected ribs 306 define the recesses 34 therbetween. Each projecting rib 306 defines a second lead-in 308 adjacent to a top surface of the second dielectric housing 30 for facilitating an engagement between the spring portion 242 of the latch 24 and the recess 34 of the second housing 30.

Figure 7:
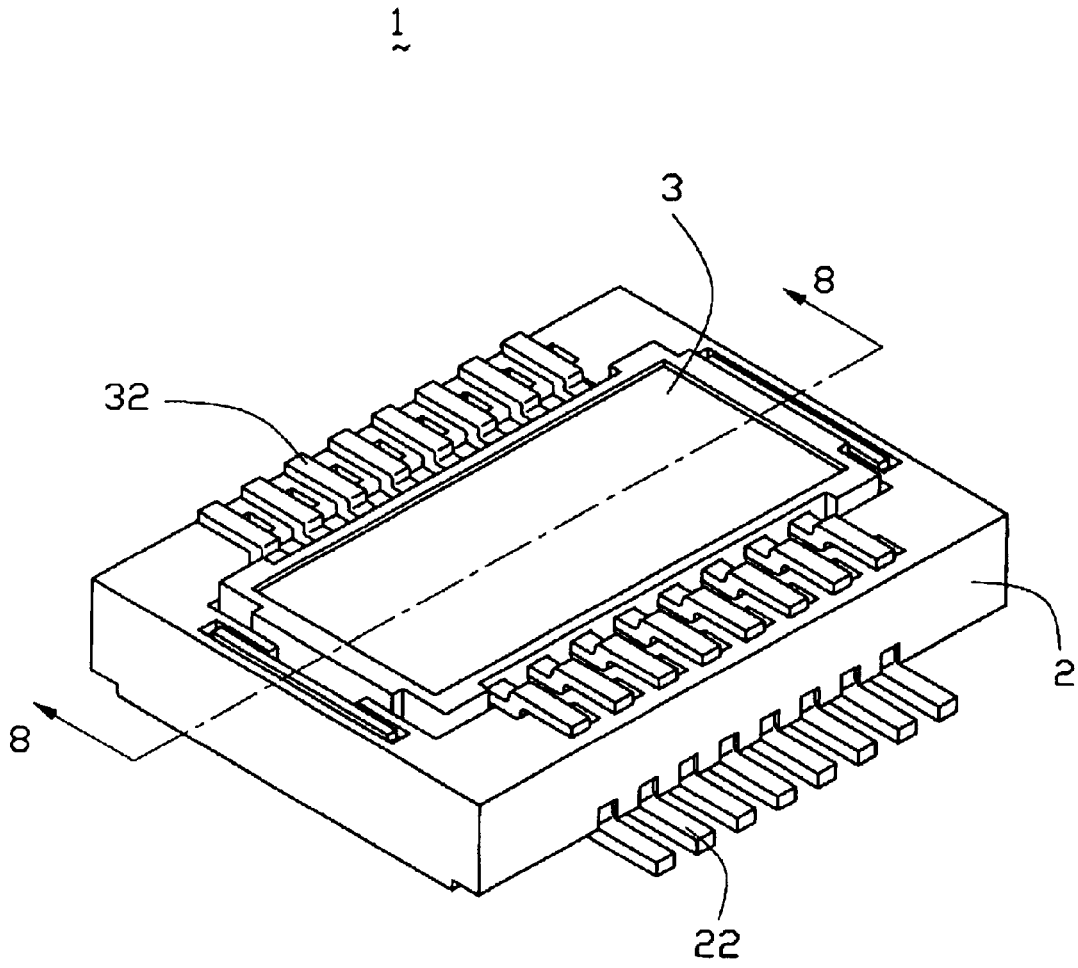
FIG. 7 is an assembled perspective view of the first and the second connectors shown in FIG. 1.
Figure 8:
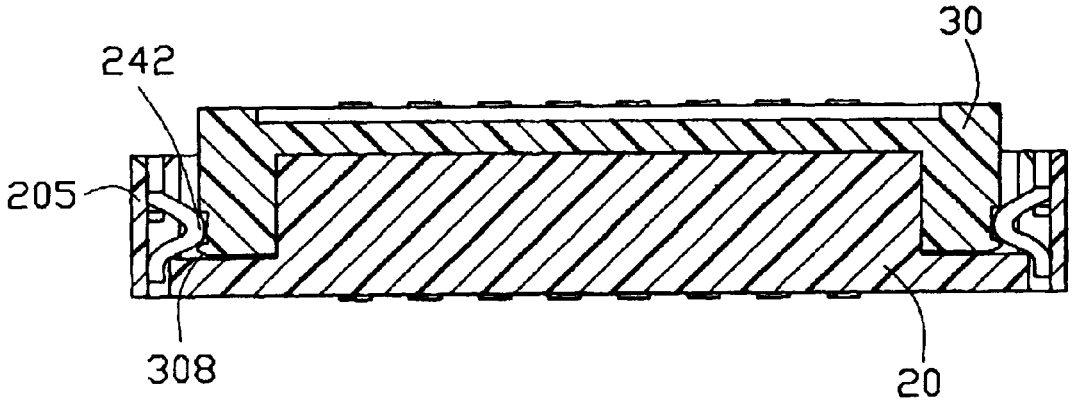
FIG. 8 is a cross-sectional view taken along line 8—8 of FIG. 7.

Referring to FIGS. 7–8, in assembly, the spring portions 242 of the latches 24 slide into the recesses 34 of the second connector 3 via the second lead-in 308 to stably engage with the recesses 34, whereby a reliable connection between the first connector 2 and the second connector 3 is ensured. When the first connector 2 is to disengage from the second connector 3, the spring portions 242 of the latches 24 are deformed inwardly and slide out of the recesses 34 to release the second connector from the fist connector. It is noted that the locking portion 246 of the latch 24 received in the slot 208 can prevent the spring portion 242 from moving too upwardly during the course of disengaging the two connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector comprising a first dielectric housing, a plurality of first terminals received in the first dielectric housing and a latch assembled on the first dielectric housing, the first dielectric housing comprising an end wall defining a receiving space, the latch comprising a retaining portion retained in the receiving space and a spring portion comprising a pair of spring legs extending downwardly from a lower end of the retaining portion, and a locking portion extending downwardly form each of the spring legs, each of the spring legs having a curved section, and the retaining portion and the locking portion being coplanar with each other; and a second connector comprising a second dielectric housing defining a recess to receive the curved sections of the spring legs and a plurality of second terminals received in the second dielectric housing and electrically connecting with the first terminals; wherein the receiving space of the first dielectric housing comprises a cutout receiving the spring portion of the latch therein, an upper indentation communicating with the cutout and receiving the retaining portion of the latch therein, and a lower slot communicating with the cutout and receiving the locking portion of the latch therein.

2. The electrical connector assembly as claimed in claim 1, wherein the retaining portion comprises a plurality of barbs on opposite longitudinal ends thereof.

3. The electrical connector assembly as claimed in claim 1, wherein the receiving space defines a lead-in at a top end thereof.

4. The electrical connector assembly as claimed in claim 1, wherein the second dielectric housing is formed with a protrusion and a projecting rib on an outer side thereof, and the protrusion and the projecting rib define the recess therebetween.

5. The electrical connector assembly as claimed in claim 4, wherein the projecting rib defines a second lead-in adjacent to a top face of the second dielectric housing.

* * * * *